United States Patent [19]

Fukuoka et al.

[11] Patent Number: 5,073,058

[45] Date of Patent: Dec. 17, 1991

[54] IMPLEMENT FOR APPLYING LIQUID

[75] Inventors: Mitsuhiro Fukuoka; Nobuaki Kobayashi, both of Osaka, Japan

[73] Assignee: Kabushiki Kaisha Sakura Kurepasu, Osaka, Japan

[21] Appl. No.: 509,660

[22] Filed: Apr. 16, 1990

[30] Foreign Application Priority Data

May 17, 1989 [JP] Japan ..... 1-56854[U]
May 22, 1989 [JP] Japan ..... 1-129770

[51] Int. Cl.[5] ..... B43K 1/06; B43K 5/00; B43K 5/06; B43K 5/18

[52] U.S. Cl. ..... 401/260; 401/206; 401/180; 401/235; 401/150

[58] Field of Search ..... 401/264, 206, 220, 180, 401/146, 150, 260, 259, 205, 204, 235, 232, 263, 278, 272, 273

[56] References Cited

U.S. PATENT DOCUMENTS

| | | | |
|---|---|---|---|
| 2,382,314 | 8/1945 | Herb | 401/150 |
| 2,601,132 | 6/1952 | Woo | 401/150 |
| 3,159,863 | 12/1964 | Mura | 401/205 X |
| 3,351,074 | 11/1967 | Aston | 401/150 X |
| 3,468,611 | 9/1969 | Ward | 401/260 X |
| 3,551,065 | 12/1970 | Molin | 401/206 |
| 3,640,631 | 2/1972 | Sotir | 401/206 |
| 4,160,256 | 7/1979 | Dziuk | 401/206 |
| 4,496,258 | 1/1985 | Tanaka et al. | 401/206 |
| 4,605,331 | 8/1986 | Held | 401/260 X |
| 4,902,155 | 2/1990 | Buschemeyer | 401/206 |
| 4,913,175 | 4/1990 | Yokosuka et al. | 401/206 X |

FOREIGN PATENT DOCUMENTS

| | | | |
|---|---|---|---|
| 155856 | 12/1952 | Australia | 401/264 |
| 123518 | 10/1984 | European Pat. Off. | 401/146 |
| 209772 | 7/1940 | Switzerland | 401/264 |
| 929953 | 6/1963 | United Kingdom | 401/206 |
| 2199239 | 7/1988 | United Kingdom . | |

*Primary Examiner*—Danton D. DeMille
*Attorney, Agent, or Firm*—Jordan and Hamburg

[57] ABSTRACT

An implement for applying a liquid includes a container for holding liquid, the container having a front end which is open and a front tube mounted on the front end of the container. The front tube has a forward outlet opening. A hollow accommodating member has an interior chamber, the accommodating member having a rear opening communicating the interior chamber with the container and a forward opening communicating the interior chamber with the front tube. A liquid feed member is movably disposed in the interior chamber between a closed position in which the liquid feed member engages the forward opening to block off communication between the interior chamber and the front tube and an open position in which the liquid feed member is disengaged from the forward opening. An end valve is axially movable in the front tube between a closed position and an open position and an open position. An applicator is mounted on the end valve. The liquid feed member is constructed such that when the implement is axially shaken, the liquid feed member temporarily moves from its closed position to its open position to pass liquid from the interior chamber of the accommodating member to the applicator.

22 Claims, 6 Drawing Sheets

IMPLEMENT FOR APPLYING LIQUID

BACKGROUND OF THE INVENTION AND RELATED ART STATEMENT

The present invention relates to an implement for applying various liquids such as inks, correcting liquids, oil paints, water paints, nail enamels and the like.

Such implements heretofore generally known comprise, for example, an ink stirring ball accommodated in a container having an ink reservoir, and an applicator attached to the forward end of the container and provided with a valve for regulating the flow of ink. When to be used, the implement is shaken in its entirety to agitate the ink within the reservoir for application.

Although such an implement is provided with the regulating valve, an excessive amount of ink is liable to flow toward the applicator to run out dropwise. This problem must be eliminated.

As means for overcoming this problem, Examined Japanese Utility Model Publication SHO No. 45-24976, for example, discloses a construction wherein a ball is provided between a pen core and a container and biased rearward against a valve seat by a spring to usually hold the pen out of communication with the interior of the container by the contact of the ball with the seat. The container is shaken immediately before use to move the ball and open the valve, whereby ink is fed from the container to the pen core.

Also, Examined Japanese Utility Model Publication SHO No. 62-29103 discloses a container provided at its forward end with a subchamber in communication with the interior of the container through a restraining portion. When the pen tip is pressed for use against the portion to which ink is to be applied, thereby pressing the container from outside, the ink is forced out from the container into the subchamber. With this construction, the ink within the container is temporarily held in the subchamber instead of flowing out directly from a forward end opening of the container. This precludes the ink from flowing out in a large quantity instantaneously when the valve is opened.

Further, Examined Japanese Utility Model Publication SHO No. 61-14472 discloses an implement which comprises a small chamber positioned at the forward end thereof and accommodating an applicator, a container in communication with the chamber through an opening, and a ball for closing the communication opening during use. When the user shakes the implement in its entirety up and down, the ball moves to agitate a liquid in the container, permitting the liquid to flow into the small chamber. The ball closes the communication opening during use to thereby restrict the amount of liquid flowing out from the forward end opening of the container.

With the implement disclosed in the above publication SHO No. 45-24976, the spring must have a relatively lower resilience to permit the ball movable to an extent. Accordingly, there is a problem that when the pressure of the ink in the container increases due to the warmth of the hand holding the container or other causes, the increased pressure allows the ball to move forwards against the biasing force of the spring, opening the valve to flow the ink dropwise.

In the case of the implement disclosed in the publication SHO No. 62-29103, the amount of ink to be forced into the subchamber varies with the pressure applied to the container. This greatly varies the quantity of ink to be applied and makes it difficult to apply the ink uniformly. Moreover, it is difficult to press the container by pressing the pen tip against the contemplated portion during application. Another problem therefore remains in that the implement is not easy to use.

The implement disclosed in the publication SHO No. 61-14472 is adapted to regulate the flow of liquid from the main liquid chamber to the small chamber by the ball but still has the likelihood that a large quantity of liquid will run out from the small chamber during application. Also, when the implement is used in a horizontal state or vertical state to apply the liquid to a vertical surface or the like, the ball cannot regulate the liquid flow. Accordingly, this implement cannot assuredly prevent the liquid from running out dropwise.

SUMMARY OF THE INVENTION

An object of the present invention is to provide a liquid applying implement free of the foregoing problems.

In order to fulfill the above object, the invention provides an implement for applying a liquid comprising a container having an opening at its front end and providing the body of the implement for holding the liquid therein, a front tube attached to the container to close the opening thereof and having an opening at its forward end for holding the interior of the tube in communication with the outside, a hollow accommodating member having a chamber in its interior and formed with a rearward communication hole and a forward communication hole for holding the chamber in communication with the interior of the container and the interior of the front tube respectively, a liquid feed member accommodated in the chamber and movable axially thereof, a first biasing member for biasing the liquid feed member toward the forward end of the front tube, an end valve disposed inside the front tube movably axially thereof and providing a liquid retaining portion in the form of a small clearance inside the front tube around the end valve for closing the forward end opening of the front tube by contacting the inner surface of a forward end portion of the front tube, a second biasing member for biasing the end valve toward the forward end of the front tube, and an applicator having a capillary action, extending through the forward end opening of the front tube and secured to the front end of the end valve, the accommodating member being formed at its forward end portion with a tapered guide portion defining an opening decreasing in area toward the forward end so as to be able to come into contact with the liquid feed member to stop the flow of liquid, the liquid feed member being movable to thereby force the liquid within the chamber of the acommodating member into the liquid retaining portion through the guide portion.

With this construction, in a state in which the implement is not given an external force such as shaking, the first biasing member causes the liquid feed member to press against the inner wall of the forward end portion of the chamber, specifically, against the guide portion serving as a valve seat. Before use, the liquid in the container flows through the rearward communication hole of the accommodating member into the chamber but cannot flow into the liquid retaining portion, i.e., the small clearance defined by the inner surface of the front tube and the end valve.

In this state, the implement is shaken axially thereof in its entirety before use, thereby reciprocatingly moving the liquid feed member within the chamber axially thereof vigorously to force the liquid in the chamber into the liquid retaining portion through the guide portion and the forward communication hole. The applicator is then pressed against the portion to which the liquid is to be applied, whereby the end valve is pushed rearward against the force of the second biasing member to open the forward end opening of the front tube. Consequently, the applicator secured to the end valve is brought into contact with the liquid held in the retaining portion, permitting the liquid to be drawn out by the capillary action of the applicator for application. The present invention therefore has the advantage that when the applicator is pressed against the contemplated portion, the liquid can be drawn out of the retaining portion approximately at a constant rate, is thereby prevented from running out dropwise and is applicable uniformly.

On the other hand, when used, the liquid feed member is held in contact with the guide portion by the force of the first biasing member. Accordingly, even if the implement is used in a sidewise or upward direction, the liquid in the container is prevented from flowing into the liquid retaining portion. Also, even if the pressure of the liquid in the container increases due to a change in the ambient temperature or to the temperature of the hand, the pressure will be transmitted in such a direction as to force the liquid feed member against the inner wall of the front portion of the chamber, i.e., against the guide portion serving as a valve seat. Accordingly, the seal between the liquid feed member and the guide portion is more assuredly maintained. Thus the dropwise leakage can be precluded with higher reliability.

Furthermore, according to the present invention, the guide portion serving as a valve seat is preferably made of permeable material, e.g., porous sintered body carrying high absorbable resin in pores thereof, or silicon rubber.

With this construction, while the applying liquid is assuredly kept from flowing into the liquid retaining portion by the contact of the liquid feed member with the guide portion, the liquid in the forward portion of the implement can be maintained at a substantially constant viscosity for a prolonged time of period because the guide portion permeates volatile solvent of the applying liquid. Also, desired flow of the applying liquid is obtainable even after put in the non-use state for a long time.

The above and other objects, features and advantages of the present invention will become more appearent upon a reading of the following detailed description and the accompanying drawings.

DETAILED DESCRIPTION OF PREFERRED EMBODIMENTS OF THE INVENTION

Figure 1:
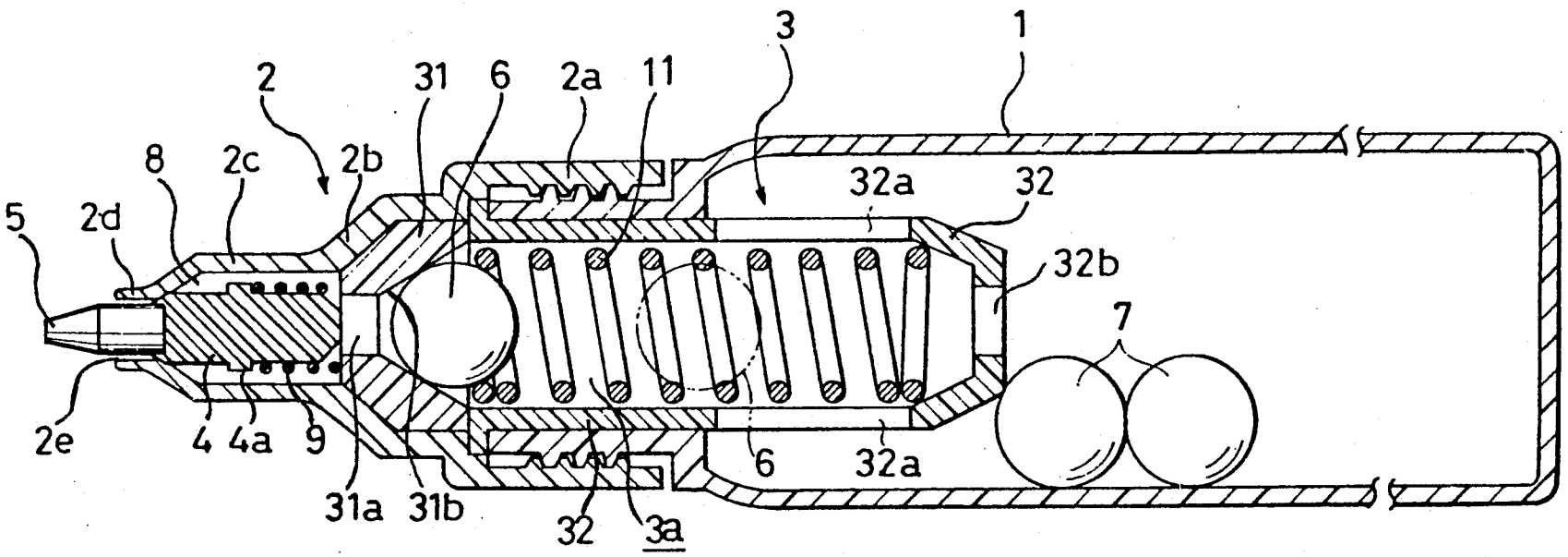
FIG. 1 is a sectional view of a first liquid applying implement of the present invention.

A first embodiment of the present invention will be described with reference to FIGS. 1 and 2.

The illustrated liquid applying implement comprises a container 1, front tube 2, accommodating member 3, end valve 4, applicator 5 and liquid feed ball (liquid feed member) 6.

The container 1, providing the body of the implement, is in the form of a hollow container having an opening at its front end (left end in FIG. 1) and contains therein the liquid to be applied. The container 1 has further accommodated therein stirring balls 7 when required (as when holding therein a pigment-containing coating composition). The implement is usable for a wide variety of liquids varying from low to relatively high in viscosity, such as inks, correction liquids, paints, oil paints, water paints, nail enamels and the like.

The front tube 2 is so shaped as to have a large-diameter portion 2*a*, tapered portion 2*b*, small-diameter portion 2*c* and forward end portion 2*d* which are arranged in this order from the rear end forward. The large-diameter portion 2*a* is attached to the front end portion of the container 1 to close the opening thereof. The forward end portion 2*d* has an opening 2*e* coaxially therewith.

The accommodating member 3 comprises two segments, i.e., a forward segment (guide portion) 31 and a rearward segment 32.

The forward segment 31 is open at both the front end and rear end thereof and is funnel-shaped (tapered) to define an opening decreasing in area toward the front end. The segment 31 is fitted in the tapered portion 2*b* of the front tube 2. The rearward segment 32 is in the form of a hollow container extending from the open front end of the container 1 rearward and is installed in place with a peripheral edge at its front end held between the front end face of the container 1 and the inner wall of the front tube 2. The forward segment 31 and the rearward segment 32 form a chamber 3*a* for accommodating the feed ball 6.

The accommodating chamber 3*a* communicates with the interior of the front tube 2 and the interior of the container 1 respectively through a forward communication hole 31*a* formed in the forward segment 31 and through rearward communication holes 32*a* formed in the rearward segment 32 and each in the form of a slit extending axially thereof. The rearward holes 32*a* are so sized as to permit the liquid in the container 1 to spontaneously flow into the chamber 3*a*.

The feed ball 6 is accommodated in the chamber 3*a* and is movable primarily axially thereof. Also, a compression spring (first biasing member) 11 is provided in the chamber 3*a* which is adapted for biasing the feed ball 6 forward. Consequently, the feed ball 6 is pressed against a tapered inner wall 31*b* of the forward segment 31, so that the forward communication hole 31*a* is closed to stop the flow of liquid.

Figure 2:
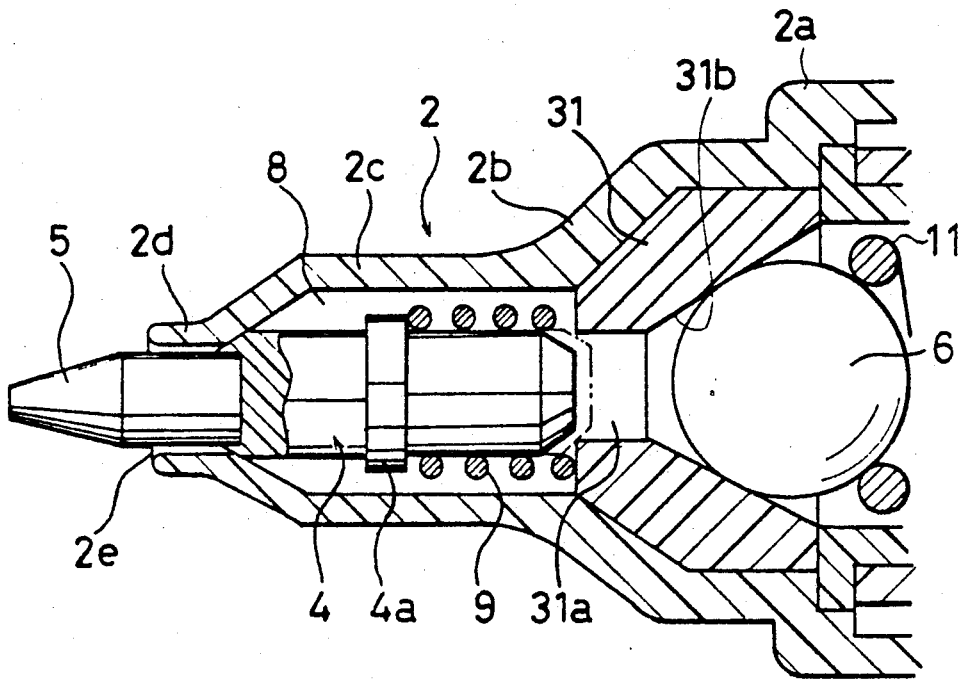
FIG. 2 is a fragmentary view in section showing a main portion of the first implement.

Indicated at 32*b* in FIG. 1 is a hole formed when the rearward segment 32 is molded. This hole need not always be provided.

The end valve 4 is accommodated in the small-diameter portion 2*c* of the front tube 2 and provides a liquid retaining portion 8 in the form of a small clearance inside the small-diameter portion 2c around the valve 4. The valve 4 has a flange 4a at an intermediate portion thereof. A compression spring (second biasing member) 9 is held between the flange 4a and the front end face of the forward segment 31. The end valve 4 is biased forward by the compression spring 9, usually into pressing contact with the inner surface of the front tube 2 (as seen in FIG. 1 and 2) to thereby close the forward end opening 2e of the front tube 2.

The applicator 5 extends through the forward end opening 2e and is secured to the front end of the end valve 4. The applicator 5 is useful insofar as it has a capillary action to draw the liquid from the retaining portion 8. Examples of useful applicators are made of the following materials and have the following structures.

(1) Bundle of fibers or brush of nylon, acrylic, polyester or like resin.

(2) Sintered body of fluorocarbon resin, polypropylene, urethane, polyethylene, EVA (ethylene-vinyl acetate copolymer) resin or the like.

(3) Foam of urethane, polypropylene, polyethylene, EVA (ethylene-vinyl acetate copolymer) resin or the like.

(4) Felt of coarse wool, polypropylene or the like.

Figure 3B:
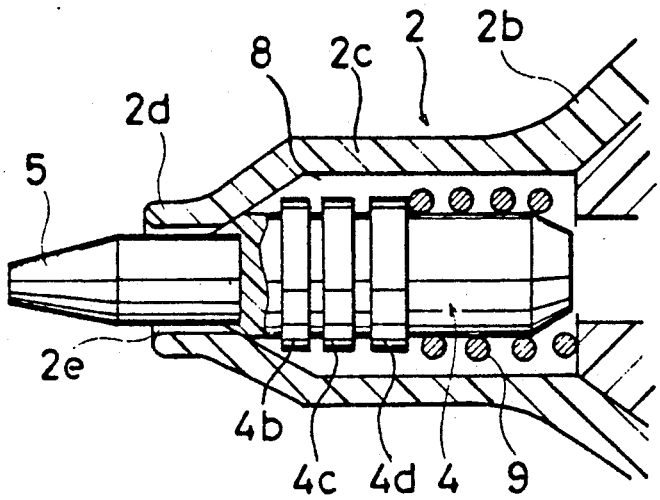
FIGS. 3A and 3B are fragmentary views in section showing another end valve.
Figure 3A:
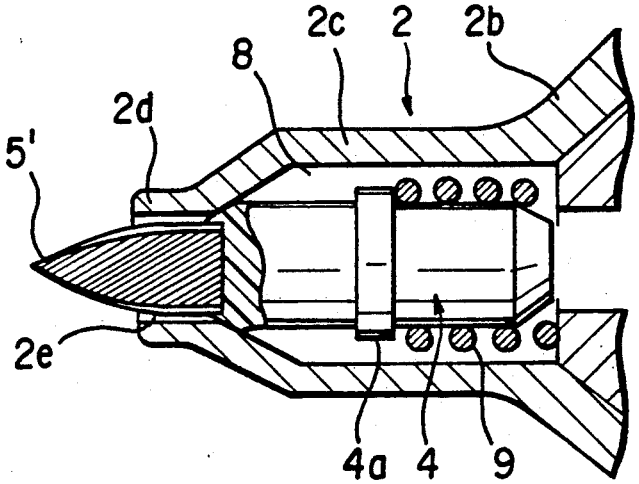

Applicators made of a hard material such as plastics, glass or metal can also be used when formed, for example, with a plurality of axial liquid grooves in the outer surface thereof to give a capillary action, as shown in FIG. 3A. The applicator 5 is not exposed to the liquid retaining portion 8 when the end valve 4 is pressed forward as illustrated but is brought into contact with the liquid in this portion 8 only when the valve 4 is pushed in rearward.

The operation of the implement will be described next.

In the usual state in which the implement is not in use, the interior of the container 1 is in communication with the chamber 3a through the rearward communication holes 32a. However, the feed ball 6 in the chamber 3a is pressed against the tapered inner wall 31b of the forward segment 31 and the chamber 3a is consequently discommunicated from the liquid retaining portion 8. Accordingly, the liquid is kept from flowing into the liquid retaining portion 8 from the container 1 and the chamber 3a.

When the implement 1 in this state is axially shaken in its entirety, the liquid feed ball 6 reciprocatingly moves vigorously within the chamber 3a against the force of the compression spring 11. When moved from a rear position (indicated in the phantom line in FIG. 1) forward during this movement, the ball 6 forces the liquid in the chamber 3a into the retaining portion 8 and the liquid in the container 1 flows into the chamber 3a.

More specifically, the reciprocating movement of the feed ball 6 causes the liquid to flow from the container 1 into the retaining portion 8 to thereby replenish the retaining portion 8 with the liquid. Since the forward segment 31 providing the front end portion of the accommodating member 3 serves as a funnel-shaped guide portion as stated above, the liquid in the chamber 3a can be smoothly forced into the retaining portion 8.

At this time, the front end of the end valve 4 is pressed against the inner surface of the front tube 2 by the elastic force of the compression spring 9 to thereby close the forward end opening 2e. This obviates the likelihood that the liquid will spill out from the end opening 2e.

Next, when the applicator 5 is pressed against the portion to which the liquid is to be applied, the applicator 5 and the end valve 4 are pushed in toward the rear end of the implement against the force of the compression spring 9. This brings the applicator 5 into contact with the liquid supplied to the retaining portion 8. Consequently, the liquid is drawn out of the implement by the capillary action of the applicator 5 and made ready for application. When the retaining portion 8 is drained of the liquid, the implement is shaken again for replenishment.

As described above, when the present implement is not in use or during application, the feed ball 6 is pressed against the tapered inner wall 31b of the forward segment 31 by the force of the compression spring 11 so that the liquid is kept from flowing into the retaining portion 8 from the chamber 3a. Also, the liquid is forced into the liquid retaining portion 8 in a small amount by the reciprocating movement of the feed ball 6, and then drawn from the retaining portion 8 by the capillary action of the applicator 5. This precludes the liquid from running out dropwise in a large quantity when the applicator 5 is pressed against the contemplated portion. Also, the present embodiment is adapted to hold the liquid retaining portion 8 out of communication with the chamber 3a by the contact of the feed ball 6 with the tapered inner wall 31b of the forward segment 31. Accordingly, even if the internal temperature of the container 1 rises to result in an increased pressure owing to a change in the ambient temperature or to the temperature of the hand, the change in the pressure will be transmitted in such a direction as to force the feed ball 6 against the tapered inner wall 31b, that is, in such a direction as to close the forward communication hole 31a. Accordingly, the dropwise leakage can be precluded with higher reliability. Moreover, even when the implement is directed in a horizontal or upward direction, the feed ball 6 assuredly regulates the flow of liquid.

Furthermore, the liquid is forced into the liquid retaining portion 8 by the reciprocating movement of the feed ball 6, and the accommodating member 3 has the front end guide portion (forward segment 31 in the present embodiment) for the liquid, so that even if a small clearance serves as the retaining portion 8, with the forward end opening 2e closed with the valve 4, the retaining portion 8 can be fully replenished with the liquid merely by shaking the implement in its entirety.

The implement of the present invention is not limited to the above embodiment in respect of the shape or construction of its components but can be modified, for example, as will be described below.

(1) When the end valve 4 is formed with a plurality of flanges 4b to 4d as shown in FIG. 3B and thereby given an increased surface area, the valve 4 and the inner surface of the front tube 2 have enhanced ability to retain the liquid, with the result that the liquid can be effectively retained in the portion 8 even when having a relatively low viscosity.

Figure 4:
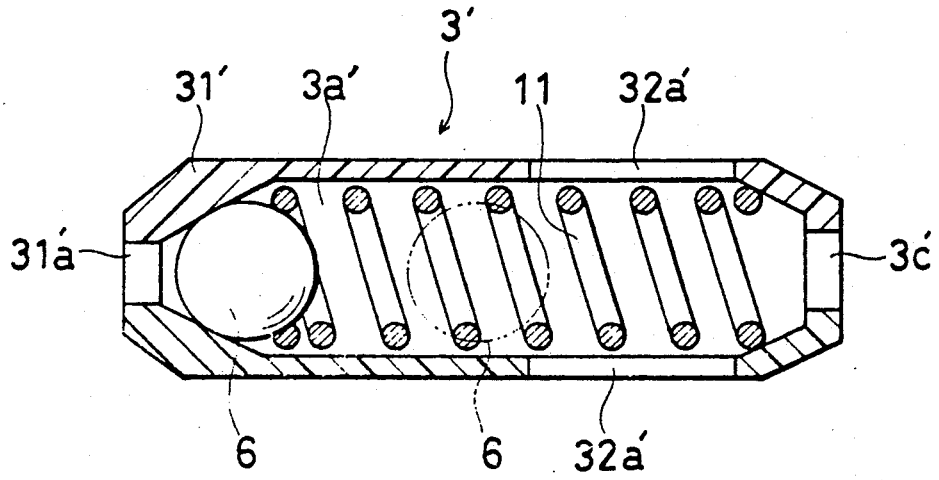
FIGS. 4 and 5 are sectional views showing another accommodating member and liquid feed member.

(2) The accommodating member of the present invention may comprise longitudinally divided segments as indicated at 3' in FIG. 4, or may be in the form of an integral member. For example, in the case of the accommodating member 3', the front end and the rear end thereof may be formed respectively with the same forward communication hole 31a' and rearward communication holes 32a' as in the above embodiment, with a tapered guide portion 31' formed inside the front end thereof. It is then possible to smoothly force the liquid into the retaining portion 8 from the chamber 3a'. Indicated at 3c' in FIG. 4 is a hole formed when the accommodating member 3' is molded.

Figure 5:
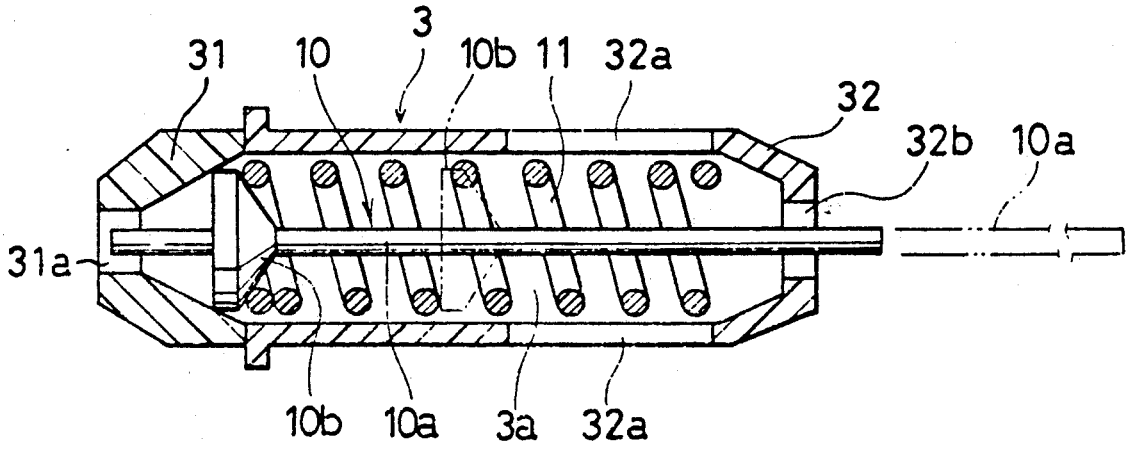

(3) Alternatively, the accommodating member 3 or 3' may be made to axially movably support thereon a liquid feed member 10 comprising a stem 10a and a conical feed portion 10b utilizing the hole 3c or 3c' as shown in FIG. 5. In this case, the feed member 10 is restrained from moving forward by the contact of the feed portion 10b with the forward segment 31 (guide portion 31').

(4) The term "applying" is used herein not in a narrow sense of the word such as "coating," such that the present implement is widely usable as a writing implement, marker or the like when the applicator 5 is suitably shaped differently.

Figure 6:
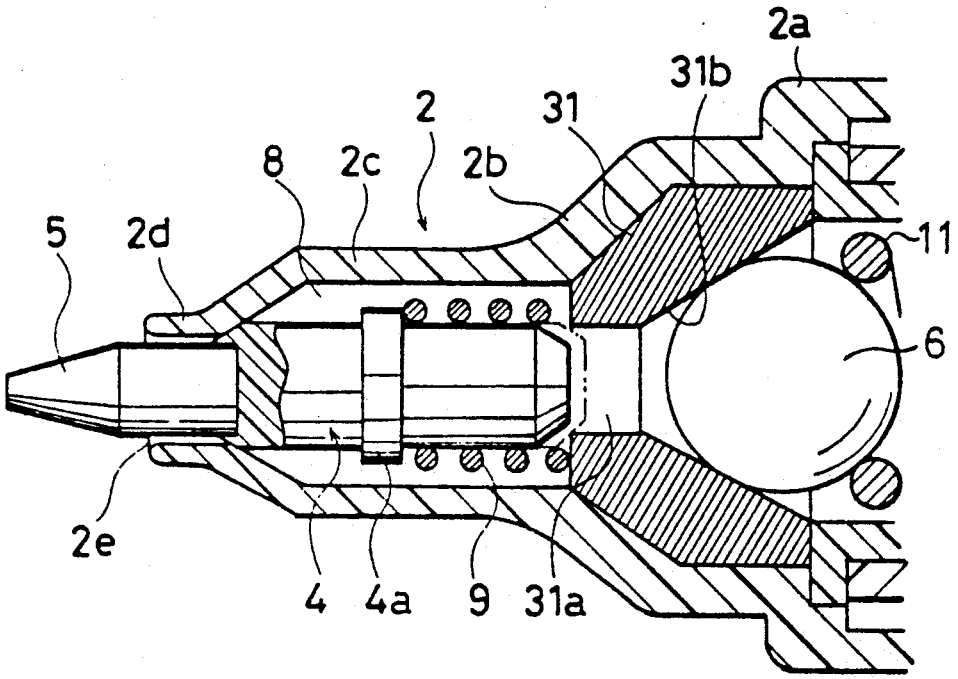
FIG. 6 is a sectional view showing a main portion of a second liquid applying implement of the present invention.

Next, a second implement of the present invention will be described with reference to FIG. 6.

In the first implement in which the flow of liquid is entirely stopped by holding the feed ball 6 in contact with the forward segment 31 during non-use or application, the small amount of liquid in a forward end portion is separated from the liquid in the container 1. When the first implement has not been used for a long time, consequently, there is a likelihood that the liquid in the forward end portion evaporates to have a higher viscosity, and consequently becomes difficult to flow smoothly.

In view thereof, the second implement is constructed so as to make it possible to assure smooth flow of the liquid in the forward end portion while having as good sealing function as the first implement.

Specifically, the construction of the second implement is identical with that of the first implement except for a fact that a forward segment 31 is made of permeable material. The term "permeable material" means one which does not permeates the applying liquid, but permeates volatile solvent of the applying liquid, e.g., water, or organic solvent such as alcohol. For the forward segment, for example, it is preferably to use porous sintered body carrying high absorbable resin in pores thereof, or vapor permeable material such as silicon rubber. For example, the porous sintered body is made of polyethylene, polypropylene, polystyrene, ethylene-vinyl acetate copolymer or the like. The high absorbable resin is made of sodium acrylate polymer, acrylic-vinyl alcohol copolymer or the like.

In the second implement constructed above, while the applying liquid in the container 1 and the accommodating chamber 3a is kept from flowing into the liquid retaining portion 8 due to the fact that the feed ball 3 is held in contact with the forward segment 31, the volatile solvent of the applying liquid is able to permeate through the forward segment 31. Consequently, the liquid in the liquid retaining portion 8 is effectively prevented from evaporating and rising in viscosity. Accordingly, this implement can assure smooth use even after put in the non-use state for a long time.

It will be seen that a valve seat made of permeable material disclosed in the second implement, i.e., the forward segment 31, can be used for implements different from those of the present invention, and assure a long storage of the implement as well as sealing of the applying liquid, similarly to the second implement.

Figure 7:
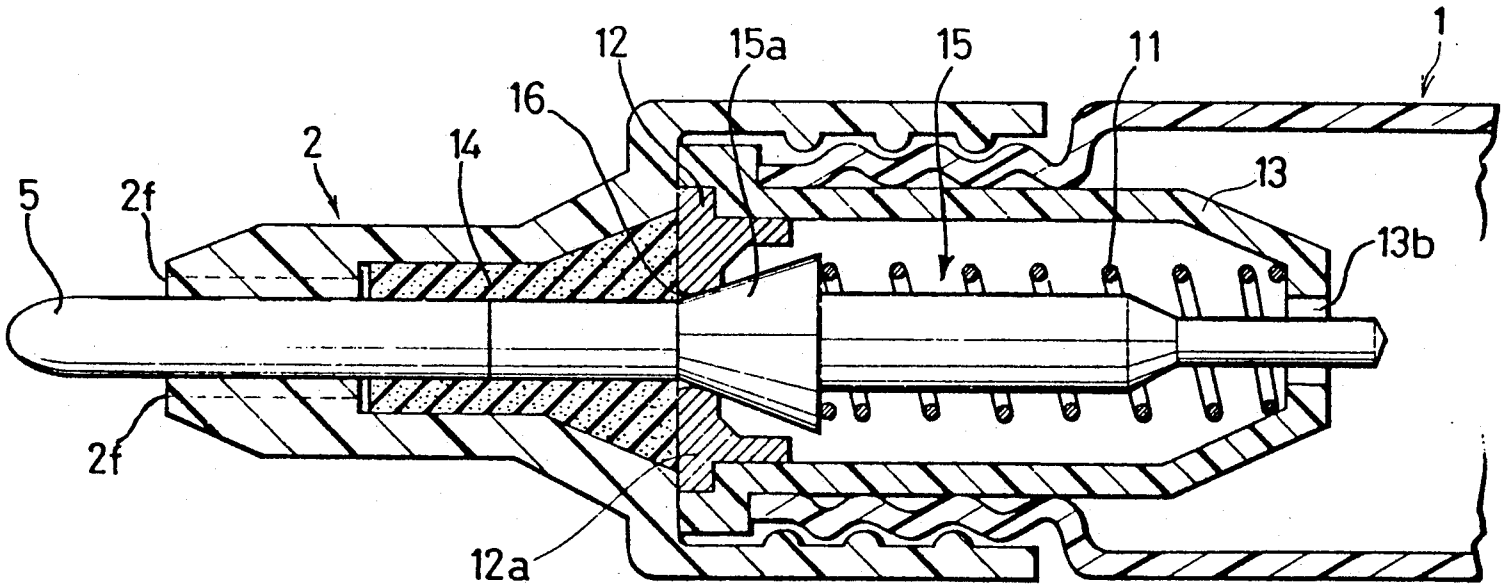
FIG. 7 is a sectional view showing a third liquid applying implement of the present invention including a valve seat having the same construction as a guide portion of the second implement.

As an example, FIG. 7 shows a paint marker including a valve seat of permeable material.

This paint marker comprises, as the second implement, a container 1, front tube 2, accommodating member 13 having an opening at its front end. A valve seat 12 made of permeable material is placed in the opening. A liquid absorbing body 14, made of urethane foam or the like, is placed within the front tube 2. An applicator 5 and a valve body 15 extend through the accommodating member 13, valve seat 12, liquid absorbing body 14, and a front portion of the front tube 2.

A front end portion of the valve body 15 is placed in a center hole of the liquid absorbing body 14, and a rear end portion of the valve body 15 extends through a rearward communication hole 13b of the accommodating member 13. The valve body 15 has a valve portion 15a at a position corresponding to a center hole of the valve seat 12. The valve portion 15a is generally in the form of a cone whose diameter increases in a rearward direction. A compression spring 11 is held between a rear end surface of the valve portion 15a and an inner surface of a rearward wall of the accommodating member 13. The tapered surface of the valve portion 15a is pressed against a peripheral surface 12a of the center hole of the valve seat 12 by the elastic force of the compression spring 11 to thereby stop the flow of liquid.

The applicator 5 is integrally attached to the front end portion of the valve body 15, and is positioned so that a rear end portion of the applicator 5 always comes into contact with the liquid absorbing body 14, and a front end portion of the applicator 5 extends through the front portion of the front tube 2 to project outward. Also, the front portion of the front tube 2 is formed with a plurality of ribs 2f surrounding the periphery of the applicator 5, so that the air flows into the front tube 2.

With this paint marker, the valve portion 15a is usually pressed against the opening peripheral surface 12a of the valve seat 12 by the force of the compression spring 11 so as to stop the flow of liquid. Accordingly, the liquid is assuredly prevented from running out dropwise. Also, a volatile solvent of the applying liquid permeates through the valve seat 12. This prevents the applying liquid in the liquid absorbing body 14 from evaporating, and enables smooth use even after put in the non-use state for a long time.

When the applying liquid in the liquid absorbing body 14 is used up, a forward end portion of the applicator 5 is pressed against the portion to which the liquid is to be applied, so that the applicator 5 and the valve body 15 are pushed in toward the rear end of the implement against the force of the compression spring 11. Consequently, the center hole 16 of the valve seat 12 opens to supply the applying liquid into the liquid absorbing body 14 from the container 1.

As mentioned above, a valve seat made of permeable material is usable for a wide variety of applying implements. The shape of a valve seat may be freely changed according to the construction of an implement.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An implement for applying a liquid comprising:

a container for holding liquid, said container having a front end which is open;

a front tube mounted on said front end of said container, said front tube having a forward outlet opening;

a hollow accommodating means having an interior chamber, said accommodating means having a rear opening means communicating said interior chamber with said container and a forward opening means communicating said interior chamber with said front tube;

a liquid feed member moveably disposed in said interior chamber between a closed position in which said liquid feed member engages said forward opening means to block off said communication between said interior chamber and said front tube and an open position in which said liquid feed member unblocks said forward opening means;

first biasing means biasing said feed member toward said closed position;

end valve means axially moveable in said front tube between a closed position in which said end valve means blocks said forward outlet opening and an open position in which said valve means unblocks said forward outlet opening;

second biasing means biasing said end valve means toward said closed position;

said front tube having an inner wall spaced from said end valve means to thereby define a clearance space between said inner wall and said end valve means, said clearance space defining a liquid retaining space for retaining said liquid;

an applicator means mounted on said end valve means and extending through said forward outlet opening, said applicator means having capillary properties;

said liquid feed member being movable from its closed position to its open position to pass liquid from said interior chamber of said accommodating member to said liquid retaining space, said applicator means being engageable with a writing surface to move said end valve means from said closed to said open position to pass liquid by the capillary action of said applicator means from said liquid retaining space through said outlet opening and onto said writing surface.

2. An implement as defined in claim 1, wherein said forward opening means comprises a tapered guide portion defining a passage decreasing in cross-sectional area toward the forward end, said feed member engaging said tapered guide portion when in said closed position to block off flow of said liquid through said passage.

3. An implement as defined in claim 2, wherein said feed member is movable in said interior chamber of said accommodating member in a forward direction to force the liquid in said interior chamber into said liquid retaining space via said passage.

4. An implement as defined in claim 1, wherein said accommodating means comprises a forward segment having said forward opening means and a rearward segment having said rear opening means.

5. An implement as defined in claim 1, wherein said accommodating means comprises longitudinally divided segments.

6. An implement as defined in claim 1, wherein the entire accommodating means is an integrally formed member.

7. An implement as defined in claim 1, wherein said rear opening means is in the form of a slit.

8. An implement as defined in claim 1, wherein said liquid feed member is a liquid feed ball.

9. An implement as defined in claim 1, wherein said liquid feed member comprises a stem and a feed portion, said liquid feed member being supported by said accommodating means and being movably axially of said accommodating means.

10. An implement as defined in claim 1, wherein said first biasing member is a compression spring provided in said accommodating means.

11. An implement as defined in claim 1, wherein said front tube is so shaped as to have a large-diameter portion, a tapered portion, a small-diameter portion and a forward end portion arranged in the order stated.

12. An implement as defined in claim 1, wherein said feed member is formed with a flange.

13. An implement as defined in claim 1, wherein said feed member is formed with a plurality of flanges.

14. An implement as defined in claim 1, wherein said applicator means comprises a bundle of fibers.

15. An implement as defined in claim 1, wherein said applicator means comprises a brush.

16. An implement as defined in claim 1, wherein said applicator means comprises a sintered body.

17. An implement as defined in claim 1, wherein said applicator means comprises a foam.

18. An implement as defined in claim 1, wherein said applicator means comprises felt.

19. An implement as defined in claim 1, wherein said applicator means is made of a hard material and is formed in its outer surface with a plurality of liquid grooves extending axially thereof.

20. An implement as defined in claim 1, wherein said forward opening means is made of a permeable material.

21. An implement as defined in claim 1, wherein said forward opening means comprises a porous sintered body carrying high absorbable resin in pores thereof.

22. An implement as defined in claim 1, wherein said forward opening means comprises silicon rubber.

* * * * *